US010086959B2

(12) United States Patent
Warner et al.

(10) Patent No.: US 10,086,959 B2
(45) Date of Patent: Oct. 2, 2018

(54) SYSTEM, APPARATUS, AND METHOD OF EFFICIENTLY TRANSFERRING MATERIAL FROM A CONTAINER TO A CARTRIDGE

(71) Applicant: Lockheed Martin Corporation, Bethesda, MD (US)

(72) Inventors: Sean Benjamin Warner, Glen Ellyn, IL (US); Richard A. Luepke, Fort Worth, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 15/900,354

(22) Filed: Feb. 20, 2018

(65) Prior Publication Data

US 2018/0170589 A1 Jun. 21, 2018

Related U.S. Application Data

(62) Division of application No. 14/251,224, filed on Apr. 11, 2014.

(51) Int. Cl.
*B65B 3/12* (2006.01)
*B30B 1/04* (2006.01)

(52) U.S. Cl.
CPC . *B65B 3/12* (2013.01); *B30B 1/04* (2013.01)

(58) Field of Classification Search
CPC . B65B 3/12; B30B 1/04; F16N 37/003; F16N 2037/006
See application file for complete search history.

(56) References Cited

U.S. PATENT DOCUMENTS 2,055,602 A 9/1936 Dodge
2,080,856 A 5/1937 Thomas
(Continued)

FOREIGN PATENT DOCUMENTS

DE 2 063 925 A1 7/1971
DE 24 32 831 A1 1/1976
(Continued)

OTHER PUBLICATIONS

EPO Germany Communication re: extended European search report (EESR) for International Application No. 15162877.3-1708; dated Jul. 3, 2015.
(Continued)

*Primary Examiner* — Timothy L Maust
*Assistant Examiner* — Timothy P Kelly
(74) *Attorney, Agent, or Firm* — Baker Botts L.L.P.

(57) ABSTRACT

In an embodiment, an apparatus includes a body comprising an inner body wall and an outer body wall centered about a longitudinal axis. The inner body wall and the outer body wall form a ridge at a first end of the body, and the ridge is configured to receive a force applied to the apparatus. The apparatus includes a base at a second end of the body. The base includes a flange configured to form a seal against a container wall and an aperture centered about the longitudinal axis. The base is centered about the longitudinal axis. The apparatus includes an inlet protruding from the base in a direction towards the first end of the body, and the inlet is configured to secure the apparatus to a nozzle of a cartridge. The apparatus is configured to force a material into the cartridge in response to the force applied to the apparatus.

7 Claims, 8 Drawing Sheets

(56) References Cited

U.S. PATENT DOCUMENTS

| | | | | |
|---|---|---|---|---|
| 2,277,437 | A | | 3/1942 | Hultgren et al. |
| 2,443,981 | A | | 6/1948 | Funk et al. |
| 2,545,605 | A | | 3/1951 | Canine |
| 2,601,169 | A | | 6/1952 | Purvis |
| 2,726,802 | A | | 12/1955 | Jones |
| 3,134,407 | A | | 5/1964 | Wegman |
| 3,168,120 | A | | 2/1965 | Cypser |
| 3,249,285 | A | | 5/1966 | Worshaw et al. |
| 3,886,711 | A | | 6/1975 | Brothers et al. |
| 4,483,375 | A | | 11/1984 | Martin |
| 4,535,823 | A | | 8/1985 | Powers |
| 4,537,335 | A | | 8/1985 | Rangwala et al. |
| 4,729,413 | A | | 3/1988 | Shults |
| 5,036,950 | A | * | 8/1991 | Clark ..... F16N 37/003 184/5.1 |
| 5,044,758 | A | | 9/1991 | Kurtz |
| 5,292,318 | A | | 3/1994 | Haber et al. |
| 5,469,897 | A | | 11/1995 | Haytner et al. |
| 5,566,729 | A | | 10/1996 | Grabenkort et al. |
| 5,785,098 | A | | 7/1998 | Sern et al. |
| 6,056,164 | A | | 5/2000 | Wakayama |
| 6,347,728 | B1 | | 2/2002 | Apolloni et al. |
| 6,655,555 | B1 | | 12/2003 | Yankoglu et al. |
| 2008/0223478 | A1 | | 9/2008 | Hantsoo et al. |
| 2008/0230565 | A1 | | 9/2008 | Hohmann et al. |
| 2011/0122020 | A1 | | 5/2011 | Springer |
| 2013/0001143 | A1 | | 1/2013 | Nelson |
| 2013/0118639 | A1 | | 5/2013 | Springer |
| 2014/0124090 | A1 | | 5/2014 | Schneider |

FOREIGN PATENT DOCUMENTS

| | | | |
|---|---|---|---|
| DE | 30 25 241 | A1 | 1/1982 |
| DE | 37 18 948 | A1 | 12/1988 |
| DE | 92 02 801 | U1 | 8/1992 |
| EP | 0236555 | A1 | 11/1986 |
| FR | 2 409 938 | A1 | 6/1979 |
| GB | 1 483 892 | A | 8/1977 |
| GB | 2 169 662 | A | 7/1986 |

OTHER PUBLICATIONS

EPO Germany Communication pursuant to Article 94(3) EPC for International Application No. 15162877.3-1708; dated May 11, 2016.

EPO, Communication pursuant to Article 94(3) EPC for International Application No. 15162877.3, dated Nov. 23, 2016.

* cited by examiner

SYSTEM, APPARATUS, AND METHOD OF EFFICIENTLY TRANSFERRING MATERIAL FROM A CONTAINER TO A CARTRIDGE

RELATED APPLICATION

This application is a divisional application of U.S. application Ser. No. 14/251,224 filed Apr. 11, 2014, and entitled "System, Apparatus, and Method of Efficiently Transferring Material from a Container to a Cartridge."

TECHNICAL FIELD

This disclosure generally relates to material transfer, and more particularly to a system, apparatus, and method of efficiently transferring material from a container to a cartridge.

BACKGROUND

Numerous situations involve transferring material from one object to a dispensing container. These situations often involve manually scooping material into the dispensing container. However, a manual process is inefficient, messy, and wastes material. Furthermore, manually scooping material may trap air in the material, which causes issues in dispensing the material.

BRIEF DESCRIPTION OF THE DRAWINGS

For a more complete understanding of the present disclosure and for further features and advantages thereof, reference is now made to the following description taken in conjunction with the accompanying drawings, in which:

FIG. 3*a* is a perspective view illustrating an example piston, according to certain embodiments of the present disclosure;

DETAILED DESCRIPTION

Many situation involve transferring material from a mixing container into a dispensing cartridge. For example, caulk may be mixed in a cup and transferred to a dispensing cartridge. As another example, a gap fill material, such as a low-observable material, may be mixed in a mixing cup and transferred to a dispensing cartridge. Current processes generally involve manually transferring, such as by scooping, the material from the mixing cup into the cartridge. However, such a manual process is messy, and wastes time and material. Because some applications involve expensive materials, such as a low-observable material used to fill gaps in stealth aircraft, wasting material results in financial loses.

Accordingly, aspects of the present disclosure include, in one embodiment, a system that includes a press tool, a container, and a piston. The press tool includes a press base, a guide rail attached to the press base that protrudes upward from the press base, and a press slidably attached to the guide rail. The press tool also includes a lever coupled to the press that slides the press along the guide rail when a force is applied to the lever. The system includes a container that is configured to be positioned on the press base. The container includes an inner container wall and an outer container wall. The container is configured to hold a material. The system includes a piston that is configured to be positioned within the container. The piston includes a body that has an inner body wall and an outer body wall centered about a longitudinal axis. The inner body wall and outer body wall form a ridge at a first end of the body. The ridge is configured to receive a force from the press. The piston includes a piston base at a second end of the body. The piston base includes a flange configured to form a seal against the inner container wall. The piston includes a base having an aperture centered about the longitudinal axis. The base is centered about the longitudinal axis. The piston includes an inlet protruding from the piston base in a direction towards the first end of the body. The inlet is configured to secure the piston to a nozzle of a cartridge.

The press tool may provide an automated, fast, repetitive manner of transferring material from a container to a cartridge. As a result, workplace efficiency is increased. Because the piston base includes a flange that forms a seal against the container wall, material loss is reduced thereby saving costs. Furthermore, the flange may prevent material from escaping the container thereby preventing messes.

Figure 1:
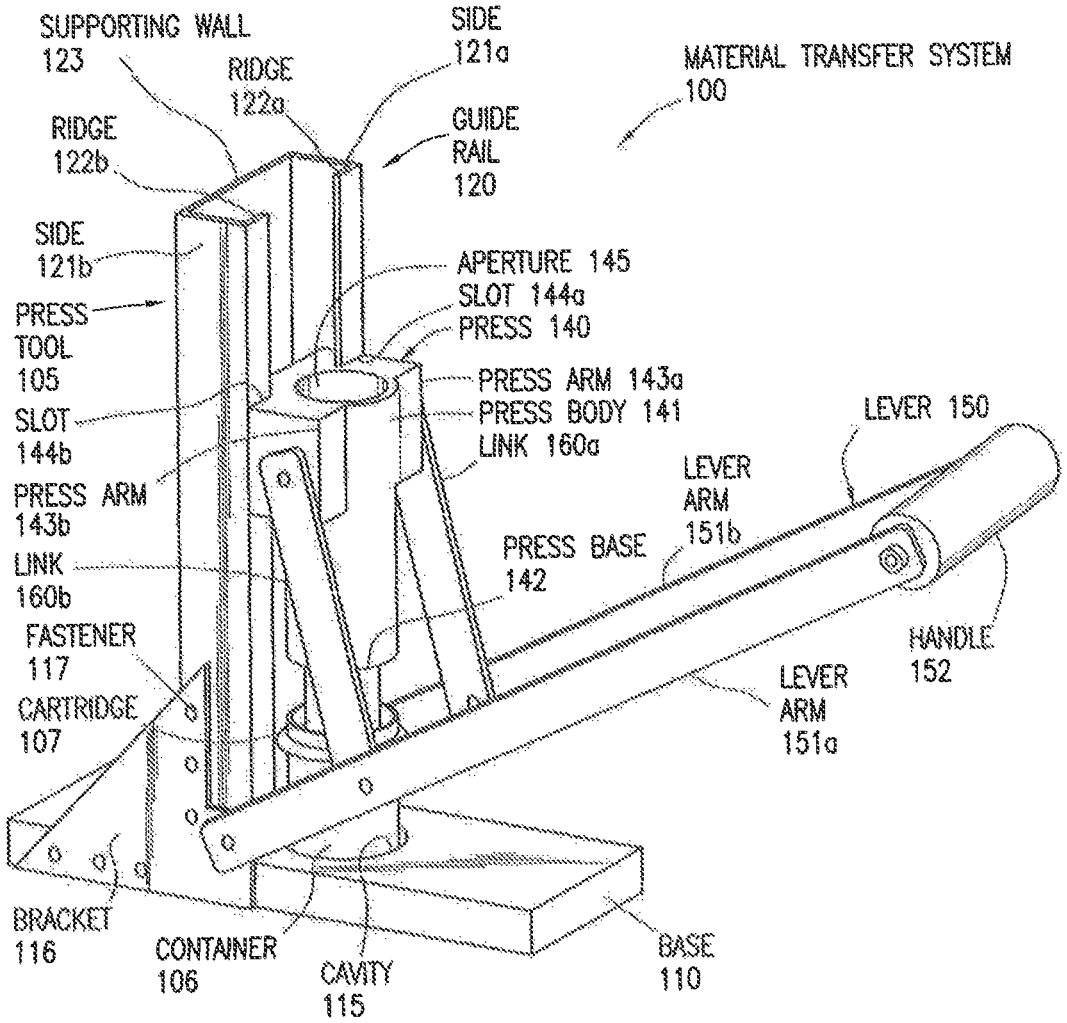
FIG. 1 is a perspective view illustrating an example material-transfer system, according to certain embodiments of the present disclosure.
Figure 2A:
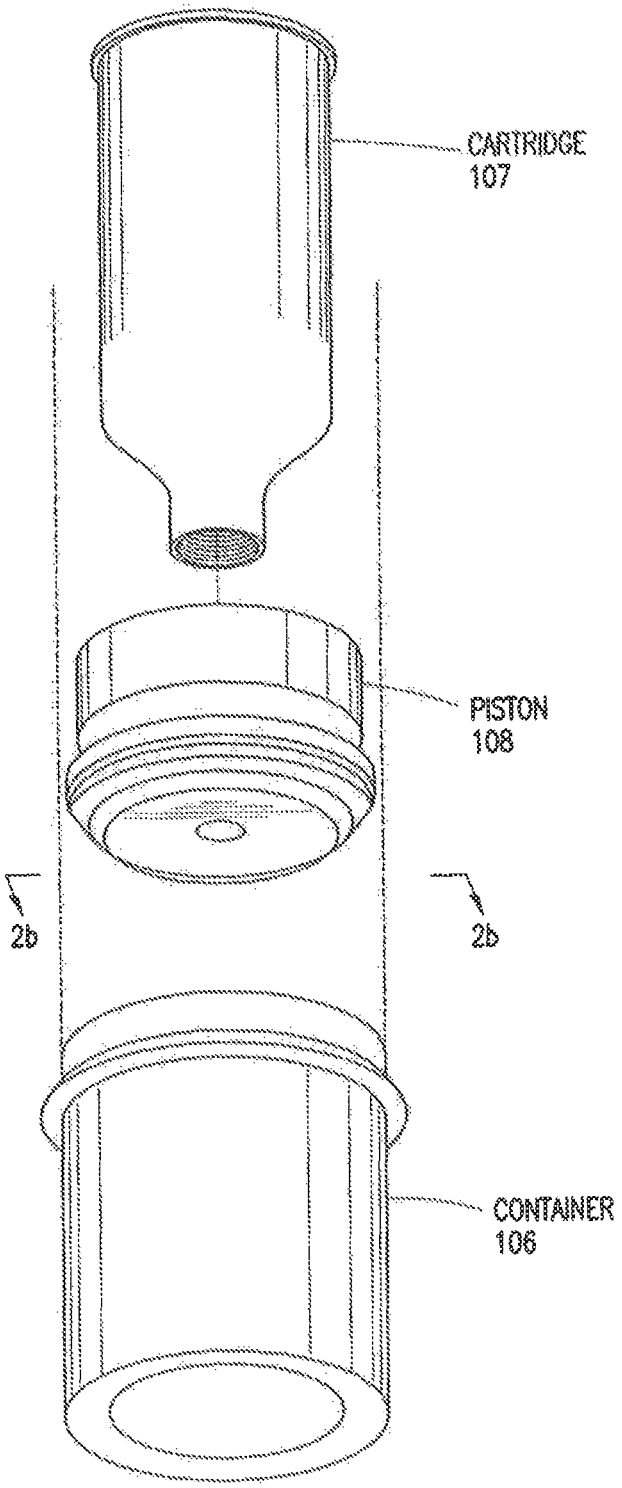
FIG. 2*a* is an exploded view illustrating an example container, piston, and cartridge that may be used in the material-transfer system of FIG. 1, according to certain embodiments of the present disclosure.
Figure 2B:
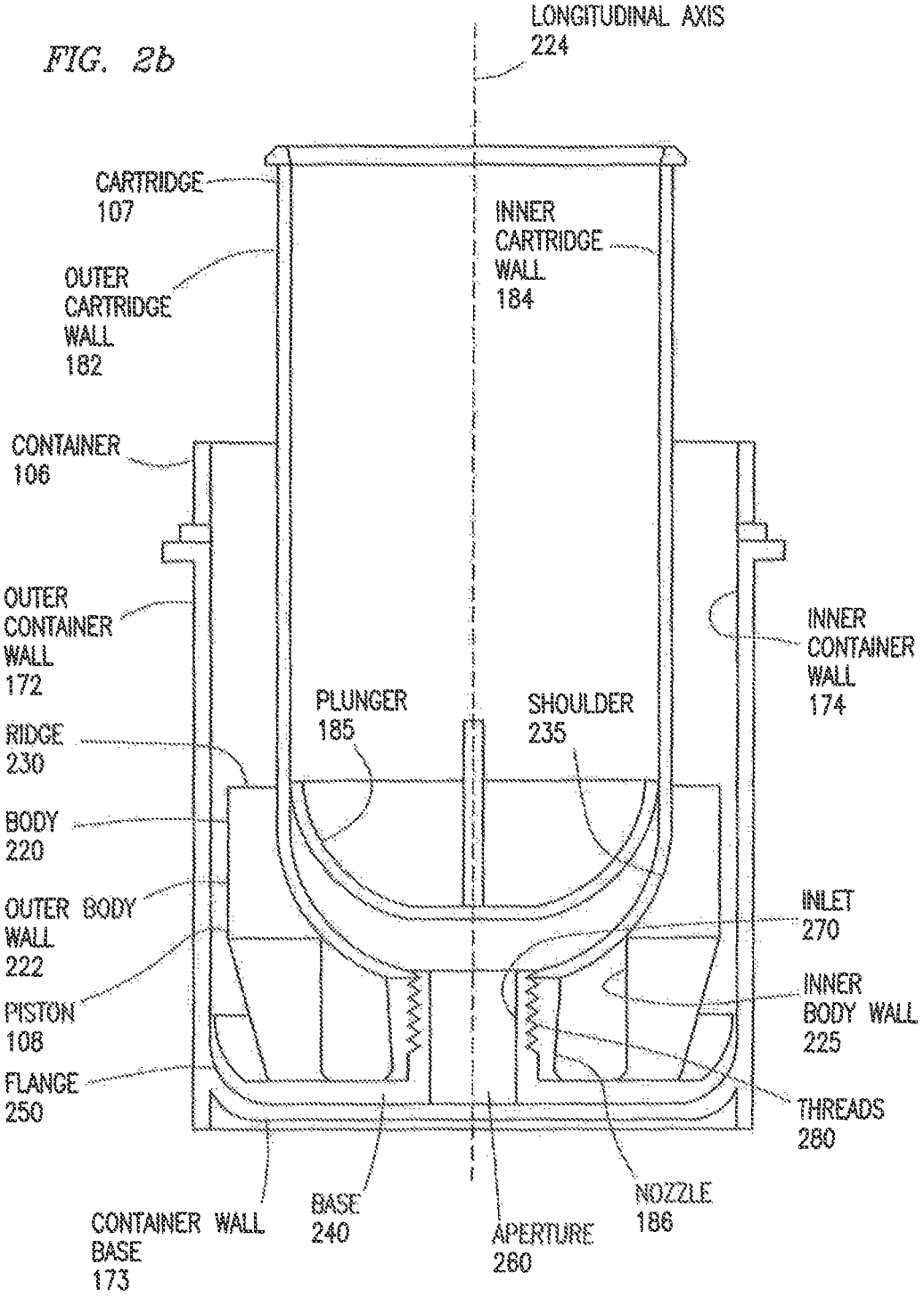
FIG. 2*b* is a section view along section, 2*b*-*b* of FIG. 2*a* illustrating the example container, piston, and cartridge of FIG. 2*a*, according to certain embodiments of the present disclosure.
Figure 9A:
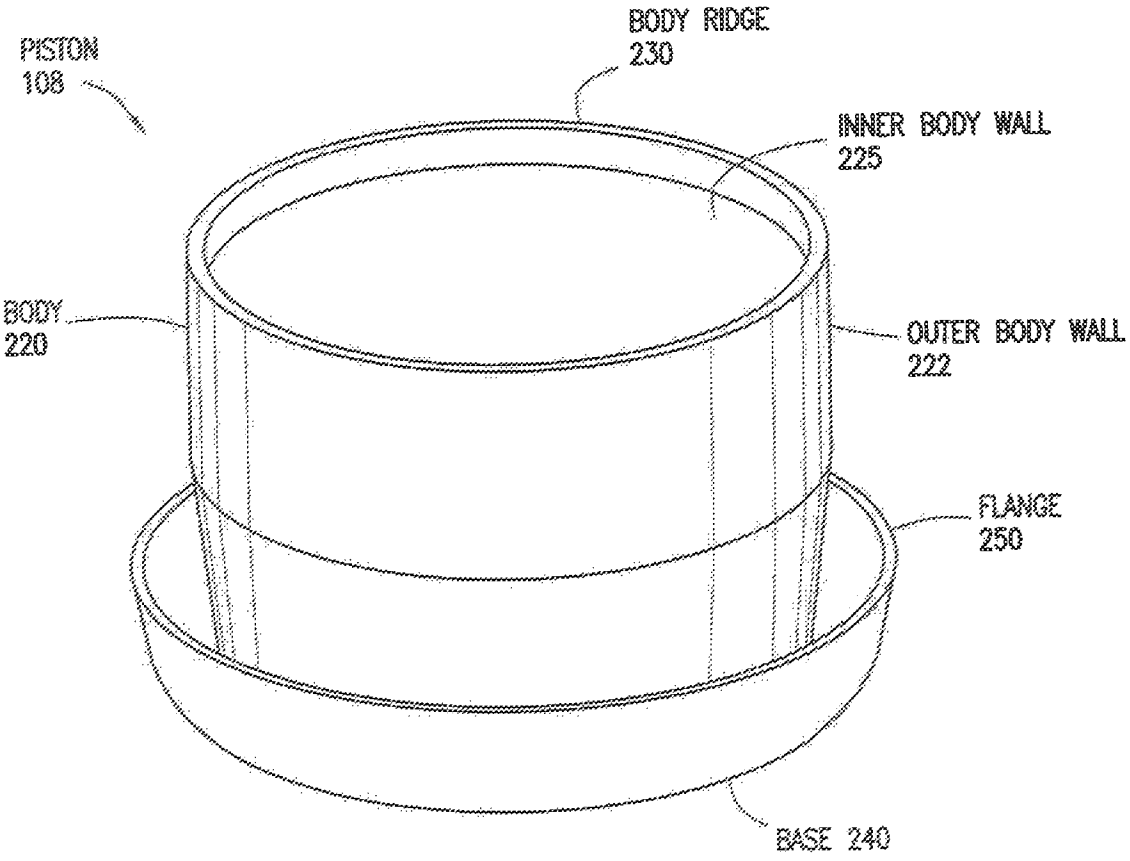
Figure 3B:
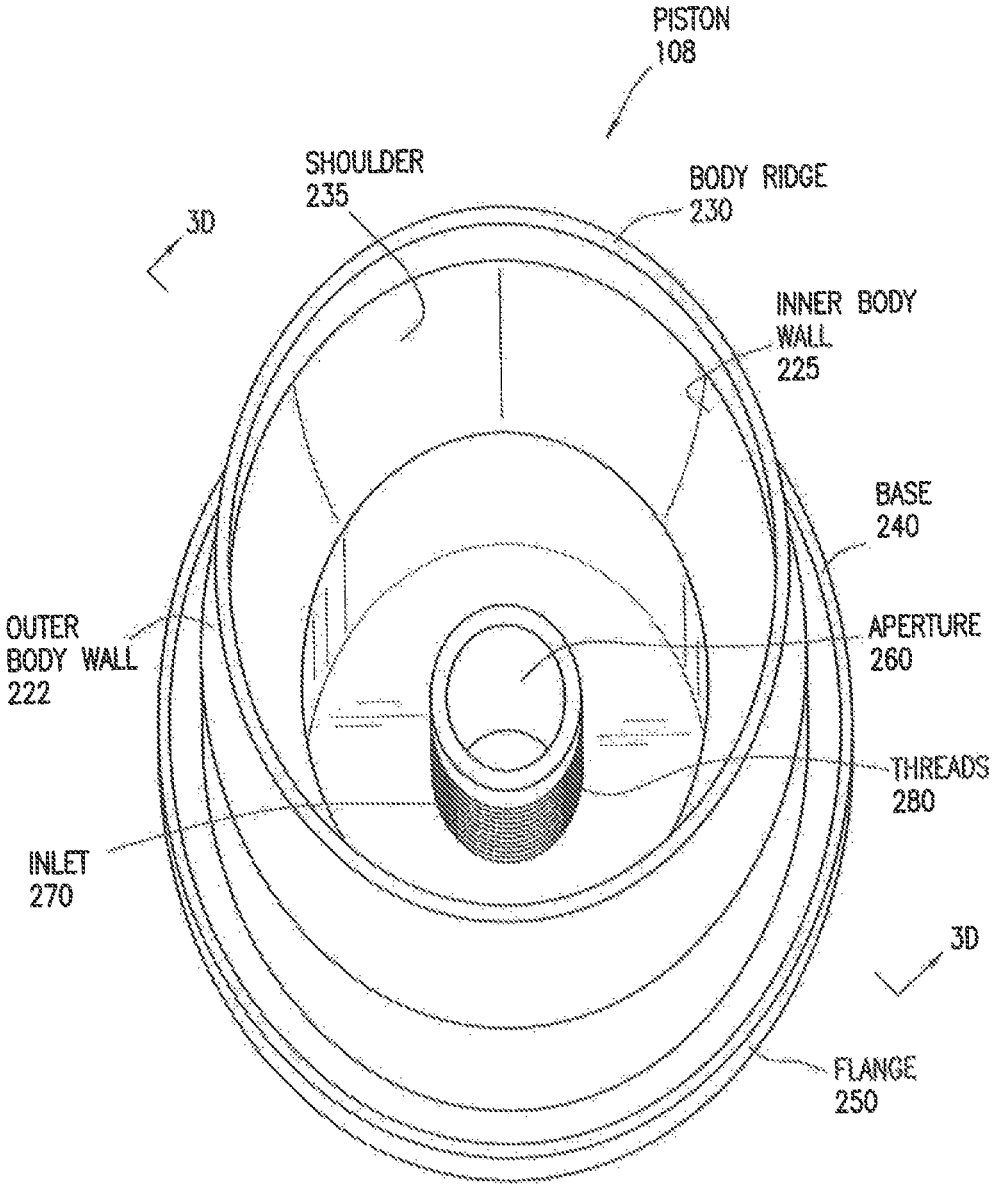
FIG. 3*b* to is a top view of the example piston of FIG. 3*a*, according to certain embodiments of the present disclosure.
Figure 3C:
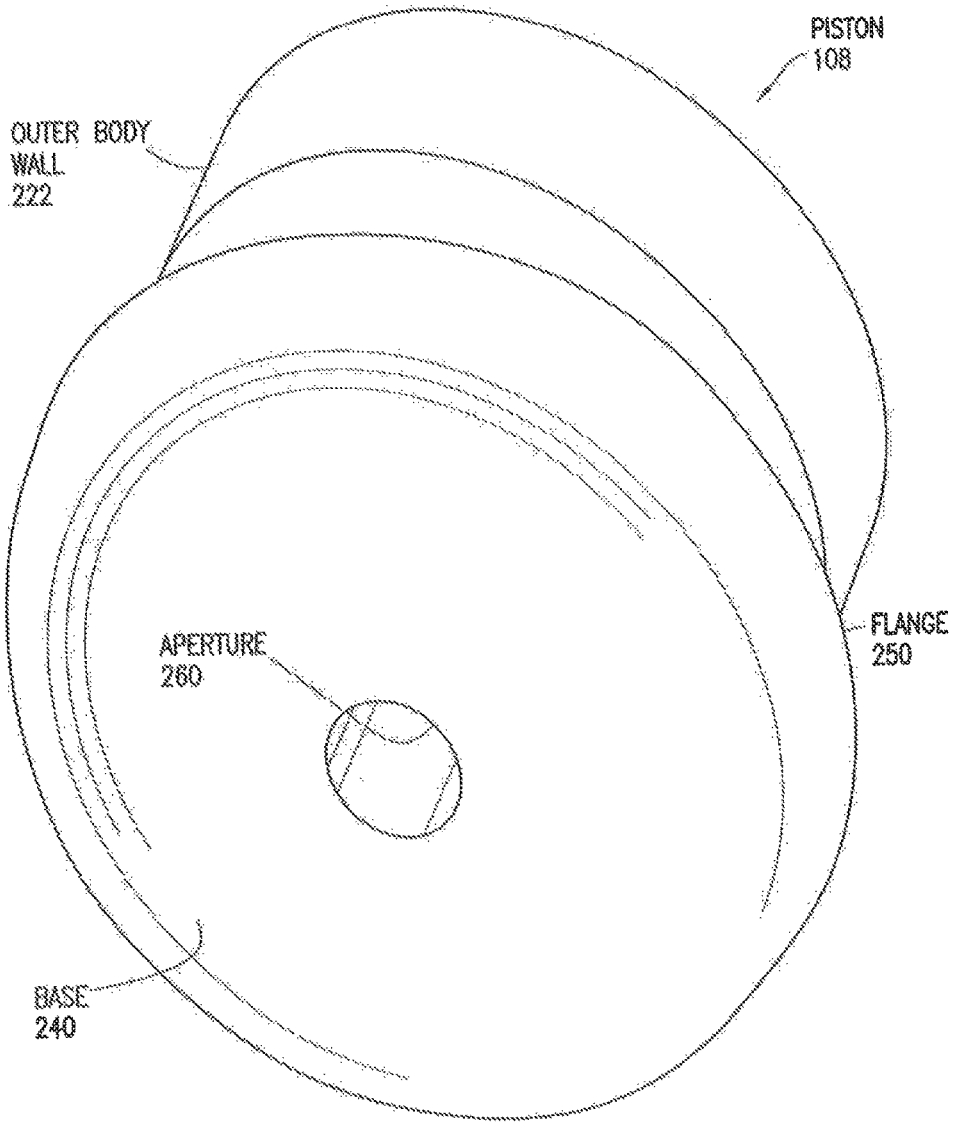
FIG. 3*c* is a bottom view of the example piston of FIG. 3*a*, according to certain embodiments of the present disclosure.
Figure 3D:
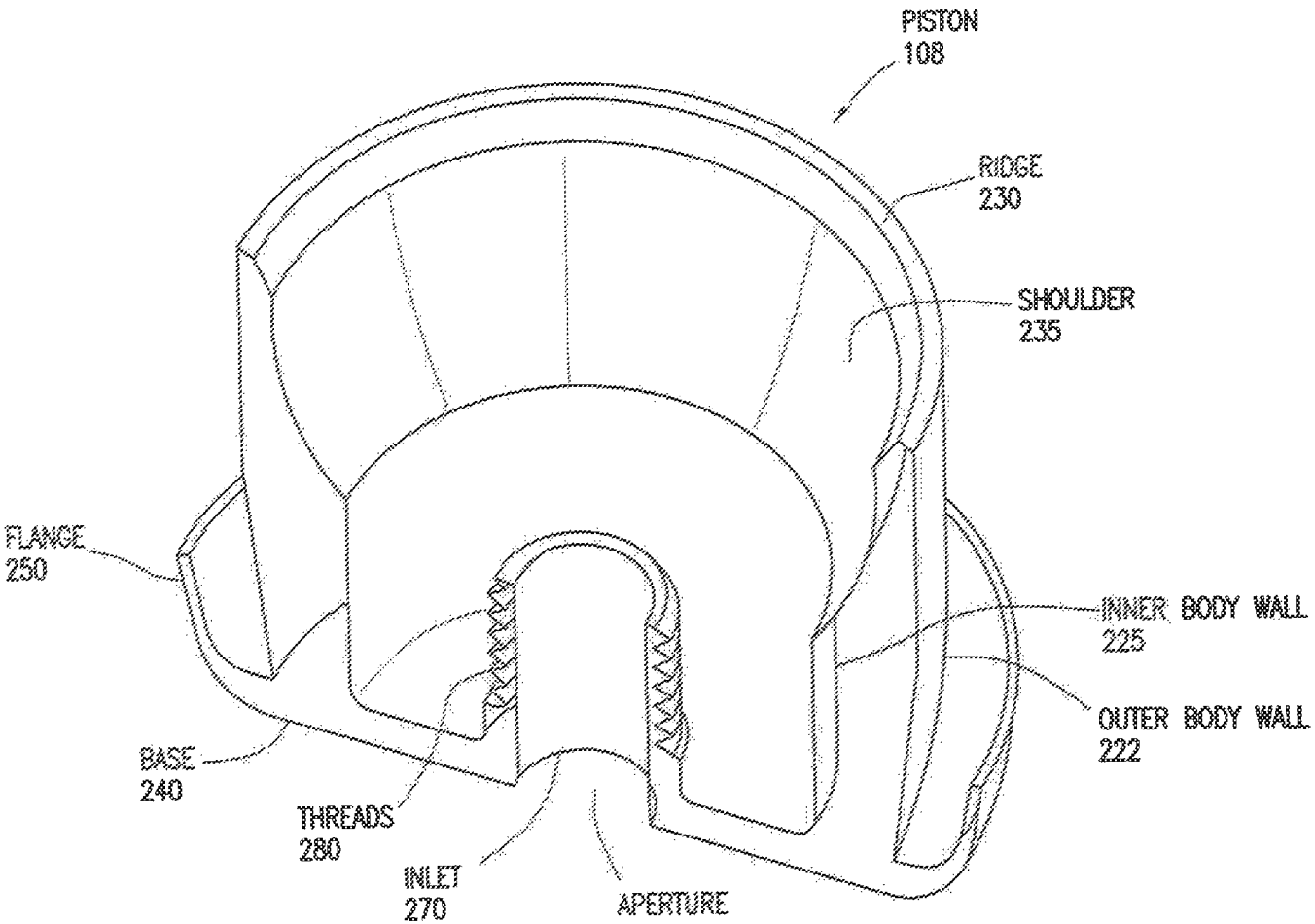
FIG. 3*d* is a section view along section 3*d*-*d* of FIG. 3*b* illustrating the example piston of FIG. 3*a*, according to certain embodiments of the present disclosure.
Figure 4:
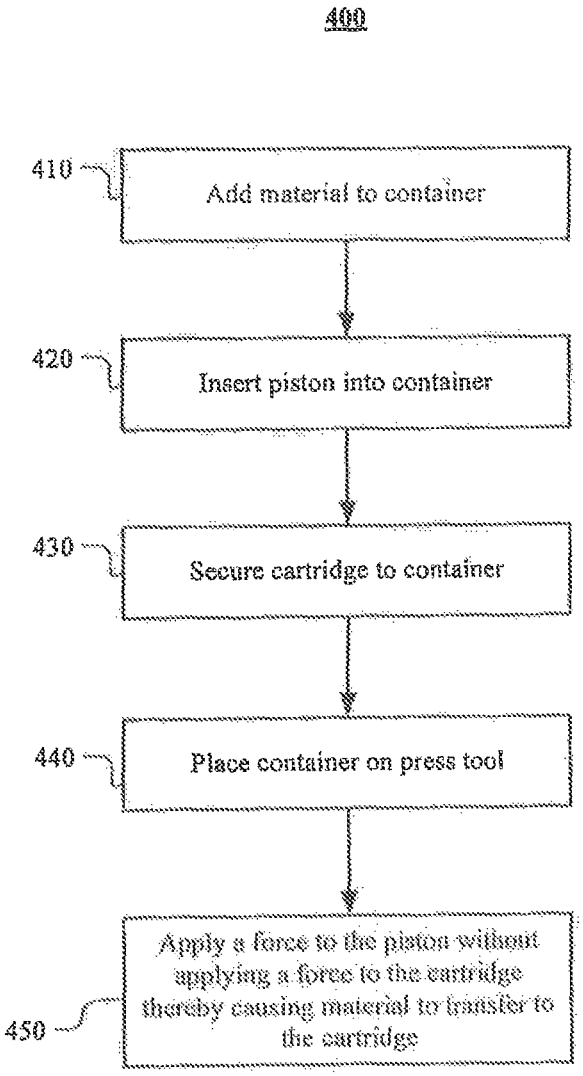
FIG. 4 is a flow chart illustrating a method of utilizing the material-transfer system of FIG. 1, according to certain embodiments of the present disclosure.

Additional details are discussed in FIGS. 1 through 4. FIG. 1 shows an example material-transfer system. FIG. 2*a* shows an example container, piston, and cartridge that may be used in the material transfer system of FIG. 1, and FIG. 2*b* shows a section view of the example container, piston, and cartridge. FIGS. 3*a*-3*d* show various views of an example piston that may be used in the material-transfer system of FIG. 1. FIG. 4 shows a flow chart illustrating an example process for using the material-transfer system of FIG. 1.

FIG. 1 illustrates material-transfer system 100, according to certain embodiments of the present disclosure. Material-transfer system 100 may include press tool 105, container 106, cartridge 107, and piston 108 (shown in FIG. 2*a*) in certain embodiments. Material-transfer system 100 may be used to transfer material from container 106 to cartridge 107 through piston 108 using press tool 105. Material-transfer system 100 provides an automated and repetitive process of transferring material. Moreover, material-transfer system 100 reduces waste as material is efficiently transferred from container 106 to cartridge 107. And because less material is wasted, business costs are reduced. Furthermore, material-transfer system 100 results in reduced mess because users no longer have to rely on manually scooping material between containers and cartridges.

Press tool 105 generally is used to apply a force to piston 108 thereby pushing material from container 106 into cartridge 107 through piston 108 in certain embodiments. Press tool 105 may include base 110, cavity 115, bracket 116, fasteners 117, guide rail 120, press 140, lever 150, and links 160*a-b* in an embodiment.

Base 110 may be any structure configured to support guide rail 120. In certain embodiments, base 110 is a flat supporting structure, which allows a user to place base 110 on another flat surface for use. Base 110 may be any shape, such as a rectangle or circle. Base 110 may be sized according to a particular application. For example, for a small mixing cup, base 110 may be less than a foot long. Base 110 may be made of any material, such as a metal or plastic. Base 110 may include cavity 115 in certain embodiments.

Cavity 115 may generally be a recess within base 110 in an embodiment. Generally, cavity 115 may be used to hold container 106 in place as a force is applied to piston 108 using press 140. Cavity 115 may be sized according to the size of container 106 in certain embodiments. Cavity 115 may be shaped according to the shape of container 106. For example, if container 106 is shaped as a square, cavity 115 may also be shaped as a square. In some embodiments, cavity 115 may not extend through base 110. In other embodiments, cavity 115 may be an aperture forming an opening in base 110 so that container 106 rests on the structure supporting press tool 105. Base 110 may be connected to guide rail 120 using bracket 116 and fasteners 117 in an embodiment.

Bracket 116 may be any structure configured to connect base 110 to guide rail 120 in certain embodiments. Bracket 116 may be any shape and/or size depending on the application. For example, as the size of base 110 and/or guide rail 120 increase, the size of bracket 116 may also increase. Bracket 116 may be made of any material, such as a metal, wood, or plastic.

Fasteners 117 may secure bracket 116 to base 110 and guide rail 120. Fasteners 117 may be any type of fastener, such as a bolt, pin, screw, dowel, nail, rivet, or adhesive. As noted above, bracket 116 and fasteners 117 secure base 110 to guide rail 120.

Guide rail 120 generally provides a rail upon which press 140 may slide in certain embodiments. In certain embodiments, guide rail 120 may be positioned perpendicular to base 110. Guide rail 120 may be made of any material such as a metal, wood, or plastic. Guide rail 120 may include sides 121*a-b*, ridges 122*a-b*, and supporting wall 123 in some embodiments. In some embodiments, sides 121*a-b*, ridges 122*a-b*, and supporting wall 123 are formed integral to each other.

Sides 121*a-b* generally provide a guiding mechanism for press 140. Side 121*a* may be parallel and opposed to side 121*b* in an embodiment. Sides 121*a-b* may be normal to supporting wall 123. Sides 121*a-b* may be hollow or solid. Sides 121*a-b* may include ridges 122*a-b* in some embodiments.

Ridges 122*a-b* generally are used to slidably attach guide rail 120 to press 140. Ridges 122*a-b* may protrude from a portion of sides 121*a-b* in certain embodiments. Ridges 122*a-b* may protrude in a direction normal to each of sides 121*a-b* in some embodiments. In some embodiments, ridges 122*a-b* are narrow protrusions sized to fit within a slot on press 140. Ridges 121*a-b* may be hollow or solid. In certain embodiments, the two opposed sides 121*a-b* of guide rail 120 may be interconnected using supporting wall 123.

Supporting wall 123 may be any structure configured to couple sides 121*a-b* together. Supporting wall 123 may be wider than sides 121*a-b* in an embodiment. Supporting wall 123 may be hollow or solid. As noted above, guide rail 120 provides a rail upon which press 140 may slide in response to a force applied to lever 150.

Press 140 may be any structure configured to apply a force to piston 108 thereby forcing material from container 106 to cartridge 107. In certain embodiments, press 140 may be made of any material such as a metal, wood, or plastic. In some embodiments, press 140 includes press body 141, press base 142, press arms 143*a-b*, slots 144*a-b* and aperture 145.

Press body 141 may be any shape, such as a cylinder, square, or circle. Press body 141 may be sized with a length according to a length of container 106, which allows press body 141 to continue on a downward path into container 106 until all material is transferred.

Press base 142 may have a diameter less than a diameter of container 106. Such a diameter allows press base 142 to fit within container 106 so that press 140 may apply a force to piston 108. Furthermore, in certain embodiments, press base 142 may have a diameter greater than cartridge 107 so that press 140 does not apply a force to cartridge 107, which extends the life of cartridge 107. Press 140 may also include press arms 143*a-b* in some embodiments.

Press arms 143*a-b* generally are used to secure press 140 to guide rail 120 and lever 150. Press arms 143*a-b* may protrude outward from press body 141. Press arms 143*a-b* may include slots 144*a-b* in some embodiments.

Slots 144*a-b* may generally be any opening configured to mate with ridges 122*a-b* of guide rail 120, such as a slot, groove, slit, channel, notch, or opening. Slots 144*a-b* may be sized according to the size of ridges 122*a-b* so that press 140 is slidably attached to guide rail 120. In an embodiment, press body 141 may have aperture 145 centered about a longitudinal axis of press 140.

Aperture 145 generally allows press 140 to slide over cartridge 107 so that press 140 does not apply a force to cartridge 107. To achieve that, aperture 145 may have a diameter greater than cartridge 107. Press 140 may be coupled to lever 150 with links 160*a-b* in an embodiment.

Lever 150 may be any lever configured to receive a force from a user or other mechanical apparatus and thereby cause press 140 to move within guide rail 120. Lever 150 may include lever arms 151*a-b* and handle 152 in an embodiment. Lever arms 151*a-b* may generally be elongated arms configured to connect handle 152 to bracket 116 or links 160*a-b*. Lever arms 151*a-b* may be opposed to each other in an embodiment. Lever arms 151*a-b* may be coupled together using handle 152 in an embodiment. Handle 152 may be any structure configured to couple lever arms 151*a-b* and receive a force from a user or other mechanical apparatus. Handle 152 may be any shape, such as a cylinder or a rectangle. Lever 150 may be coupled to bracket 116 and/or base 110 in an embodiment. For example, lever 150 may be coupled to bracket 116 using fasteners 117. As another example, lever 150 may be coupled to base 110 using fasteners 117. Lever 150 may apply a force to press 140 through links 160*a-b*.

Links 160*a-b* may be any structure configured to attach press 140 to lever 150 in certain embodiments. For example, links 160*a-b* may be two opposed arms in an embodiment. Links 160*a-b* may be elongated members in an embodiment. In some embodiments, links 160*a-b* may be coupled to lever 150 using any type of fastener. Links 160*a-b* may also be coupled to press 140 using any type of fastener. In some embodiments, links 160*a-b* are respectively attached to press arms 143*a-b*. In other embodiments, links 160*a-b* are respectively attached to opposite sides of press body 141. In an embodiment, links 160 may be made of any type of material, such as a metal, wood, or plastic.

As an example embodiment of operation, a user may fill container 106 with material and place container 106 within cavity 115 of base 110. A user may attach cartridge 107 to piston 108 as will be described below. The user may then place cartridge 107 and piston 103 into container 106. Alternatively, the user may place piston 108 into container 106 prior to attaching cartridge 107 to piston 108. The user may apply a force to lever 150 thereby causing press 140 to slide down along guide rail 120. The downward force of press 140 may cause the material in container 106 to rise through piston 108 into cartridge 107 thereby filling cartridge 107. In such a manner, material-transfer system 100 provides a repetitive and fast way to transfer material between container 106 and cartridge 107. Although described as performed by a user, a mechanical apparatus may perform the same steps as a user, such as applying a force to lever 150.

FIG. 2*a* is an exploded view illustrating an example container 106, cartridge 107, and piston 108 that may be used in material-transfer system 100 of FIG. 1, according to certain embodiments of the present disclosure. FIG. 2*b* is a section view along section 2*b*-*b* of FIG. 2*a* illustrating the example container 106, cartridge 107, and piston 108 of FIG. 2*a*, according to certain embodiments of the present disclosure. Container 106, cartridge 107, and piston 108 will be described with reference to FIGS. 2*a* and 2*b*.

Container 106 may hold both cartridge 107 and piston 108 in addition to material in an embodiment. Cartridge 107, as will be described below, may be attached to piston 108 in certain embodiments. In some embodiments, cartridge 107 and piston 108 may be placed within container 106 so that material may be transferred from container 106 to cartridge 107 in an efficient manner.

Container 106 may be any type of container configured to hold material in certain embodiments. For example, container 106 may be a mixing cup. In some embodiments, container 106 may be a mixing cup used in a centrifugal mixing process. In some embodiments, container 106 may have an outer container wall 172 and inner container wall 174. Outer container wall 172 and inner container wall 174 may be centered about longitudinal axis 224 in certain embodiments. Container 106 may also have container wall base 173. Container wall base 173 may be connected to outer container wall 172 and inner container wall 174. In some embodiments, container wall base 173 may be formed integral with outer container wall 172 and inner container wall 174. In an embodiment, container wall base 173 may be solid such that material may not escape from container 106. Container 106 may generally be any shape, such as cylindrical, circular, or rectangular. Container 106 may be made of any type of material, such as a plastic, wood, or metal. Container 106 may have a diameter or width large enough to fit cartridge 107 and piston 108 within container 106.

Cartridge 107 may generally be any type of cartridge configured to hold and dispense material. For example, cartridge 107 may be a dispensing cartridge, such as a Semco® cartridge. As another example, cartridge 107 may be a cartridge for a caulking gun. Cartridge 107 may be any shape, such as a cylinder or rectangle. In an embodiment, cartridge 107 may include outer cartridge wall 182, inner cartridge wall 184, plunger 185, and nozzle 186.

Outer cartridge wall 182 and inner cartridge wall 184 generally prevent material from escaping cartridge 107. Outer cartridge wall 182 and inner cartridge wall 184 may be centered about longitudinal axis 224. Cartridge 107 may include plunger 185 mounted within cartridge 107.

Plunger 185 may be any component configured to force material out of cartridge 107 in certain embodiments. Plunger 185 may be shaped according to the shape of a portion of inner container wall 184. Plunger 185 may be positioned near nozzle 186 before cartridge 107 is filled. Such a position prevents air bubbles from entering the material as it is transferred from container 106 to cartridge 107. As material is transferred to cartridge 107, plunger 185 moves toward an end of cartridge 107 opposite to nozzle 186. Once cartridge 107 is filled, a user may press on plunger 185 to dispense material from cartridge 107.

Nozzle 186 may generally be used to secure cartridge 107 to inlet 270 of piston 108. Nozzle 186 may also be used to increase the speed of material exiting cartridge 107. Nozzle 186 may have threading on its interior that mates with threads 280 of inlet 270 so that cartridge 107 may be secured to piston 108.

Piston 108 may be configured to force material from container 106 into cartridge 107 in response to a force applied from press 140 of press tool 105 in certain embodiments. Generally, piston 108 is placed within container 106 and on top of any material in container 106. Piston 108 will now be described with reference to FIGS. 3*a* through 3*d*. FIG. 3*a* is a perspective view of piston 108, FIG. 3*b* is a top view of piston 108, FIG. 3*c* is a bottom view of piston 108, and FIG. 3*d* is a section view along section 3D-D of FIG. 3*b* illustrating piston 108. Piston 108 generally includes body 220, piston base 240, flange 250, aperture 260, and inlet 270 in certain embodiments.

Body 220 of piston 108 may generally be configured to support a portion of cartridge 107. Body 220 may be made of any material, such as a rubber or plastic. Generally, body 220 is shaped according to the shape of container 106. For example, body 220 may be circular, cylindrical, or rectangular. Body 220 includes outer body wall 222, inner body wall 225, body ridge 230, and shoulder 235.

Outer body wall 222 and inner body wall 225 may be portions of piston 108 protruding from piston base 240. Outer body wall 222 and inner body wall 225 may support portions of cartridge 107. Outer body wall 222 and inner body wall 225 may be solid or hollow. Outer body wall 222 and inner body wall 225 may be centered about longitudinal axis 224 as shown in FIG. 2*b*. Outer body wall 222 and inner body wall 225 may be interconnected at one end of piston 108 by body ridge 230 in an embodiment.

In some embodiments, body ridge 230 may form a flat ridge upon which a force is applied from press tool 105. Body ridge 230 may be sized according to a portion of press base 142 of press 140. Thus, body ridge 230 receives a force from press 140 so that no force is applied to cartridge 107. By not applying a force to cartridge 107, the life of cartridge 107 is extended. Body 220 may include shoulder 235 in an embodiment.

Shoulder 235 may be an angled portion of inner body wall 225 that matches to the shape of cartridge 107 in some embodiments. Shoulder 235 way provide support for cartridge 107 when cartridge 107 attached to piston 108. Body 220 connects to piston base 240 at one end of body 220 in an embodiment.

Piston base 240 may generally apply a force to material in container 106 thereby causing the material to transfer from container 106 to cartridge 107. Piston base 240 may be wider in diameter or width than body 220 in an embodiment. Piston base 240 may be shaped according to the shape of container 106. For example, if container 106 is circular, then piston base 240 may also be circular. In some embodiments, piston base 240 may be any shape, such as a rectangle, square, or circle. Piston base 240 may be solid or hollow. Piston base 240 may be made of any material, such as a rubber or plastic. Piston base 240 may be formed integral to body 220 in an embodiment. Piston base 240 may include flange 250 at an edge of piston base 240.

Flange 250 generally prevents material from rising above piston base 240 of piston 108. Flange 250 may protrude upwardly away from piston base 240 in an embodiment. In other embodiments, flange 250 may protrude at an angle away from piston base 240. Flange 250 may be configured to form a seal against inner container wall 174 in an embodiment. In an embodiment, flange 250 is configured to form a seal against inner container wall 174 by having a shape matching at least a portion of the shape of inner container wall 174. For example, if one portion of inner container wall 174 is curved in shape, flange 250 may be formed so as to match the curved shape of inner container wall 174. In some embodiments, flange 250 is configured to form a seal against inner container wall 174 by having a radius greater than or equal to the radius of inner container wall 174. By forming a seal against inner container wall 174, material cannot escape above flange 250. As a result, flange 250 facilitates an efficient transfer of material from container 106 to cartridge 107 without wasting material. Moreover, flange 250 prevents workplace messes as material cannot escape above flange 250. Flange 250 may be made of any material, such as a rubber or plastic. In addition to flange 250, piston base 240 may also include aperture 260.

Aperture 260 may be an opening through piston base 240 in an embodiment. Aperture 260 generally allows material to rise from container 106 into cartridge 107. Aperture 260 may be centered about longitudinal axis 224 as shown in FIG. 2*b*. Aperture 260 may be any shape, such as a circle, square, or rectangle. Aperture 260 may extend through piston base 240 and inlet 270.

Inlet 270 protrudes outward from piston base 240 in certain embodiments. Inlet 270 may protrude in a direction normal to piston base 240 and towards an end of body 220 opposite to piston base 240 in certain embodiments. In an embodiment, inlet 270 may include an inner inlet wall and an outer inlet wall. In an embodiment, inner inlet wall and outer inlet wall may be centered about longitudinal axis 224. Inner inlet wall may be positioned proximate to longitudinal axis 224 and outer inlet wall may be positioned distal to longitudinal axis 224. Inlet 270 may generally be any shape configured to mate with nozzle 186 of cartridge 107. For example, inlet 270 may be circular in shape so as to mate with a circular nozzle of cartridge 107. Inlet 270 generally secures piston 108 to nozzle 186 of cartridge 107. Inlet 270 may include threads 280 on the outer inlet wall for securing cartridge 107 to piston 108.

Threads 280 may be any suitable threading configured to mate with threading on nozzle 186 of cartridge 107. Threads 280 may be positioned on outer inlet wall of inlet 270.

As an example embodiment of operation, piston 108 is secured to cartridge 107 using threads 280 on inlet 270 of piston 108. Cartridge 107 and piston 108 are then placed within container 106. Flange 250 of piston 108 forms a seal against inner container wall 174 as piston 108 is secured in container 106. Container 106 may include a material, such as a low observable material. Container 106, cartridge 107, and piston 108 may be placed on base 110 of press tool 105 in certain embodiments. A user or any mechanical apparatus (e.g., a hydraulic piston) then may apply a downward force to lever 150 thereby causing press 110 to slide downwards along guide rail 120. Press 140 slides into container 106 and applies a force to ridge 230 of piston 108 without applying a force to cartridge 107. The force applied to ridge 230 pushes piston 108 downward into container 106 thereby causing the material within container 106 to rise through aperture 260 of piston 108. The material rises through inlet 270 into cartridge 107. As the material rises, the material pushes plunger 185 towards an end of cartridge 107 opposite of nozzle 186. Flange 250 prevents the material from escaping container 106. In this manner, cartridge 107 is filled with material from container 106. This process provides an efficient process for transferring material from container 106 to cartridge 107. Moreover, air bubbles are prevented from entering the material during the transfer process.

FIG. 4 is a flow chart illustrating method 400 of utilizing material-transfer system 100 of FIG. 1, according to certain embodiments of the present disclosure. Method 400 begins at step 410, where material is added to container 106 in an embodiment. The material may be any type of material. In an embodiment, the material may be a low-observable material. For example, the material may be a gap fill material used to fill gaps between panels of a stealth aircraft. In some embodiments, the material may first be mixed in container 106 using a centrifugal mixing process.

At step 420, piston 108 may be inserted into container 106 in an embodiment. For example, a user (or mechanical apparatus) of material-transfer system 100 may insert piston 108 into container 106 so that piston 108 is positioned on top of the material. In some embodiments, the user may ensure that flange 250 of piston 108 has formed a seal against inner container wall 174 of container 106. As noted above, inserting piston 106 into container 106 facilitates a clean material transfer that reduces waste and saves costs.

At step 430, cartridge 107 may be secured to piston 108 in an embodiment. In certain embodiments, cartridge 107 is secured to piston 108 by screwing nozzle 186 of cartridge 107 onto threads 280 of inlet 270. In some embodiments, cartridge 107 may be secured to piston 108 before material is added to container 106. In some embodiments, cartridge 107 may be secured to piston 108 before piston 108 is inserted into container 106.

At step 440, container 106 may be placed onto press tool 105 in an embodiment. In some embodiments, container 106 is placed within cavity 115 of press tool 105. Container 106 may be placed onto press tool 105 before piston 108 is inserted into container 106 in certain embodiments.

At step 450, a force may be applied to piston 108 using press tool 105 without applying a force to cartridge 107. For example, press tool 105 may apply a force to ridge 230 of piston 108 without applying a force to cartridge 107. In such a manner, the life of cartridge 107 is preserved because no forces deform cartridge 107. As a result of the force on piston 108, material is transferred from container 106 to cartridge 107 through piston 108.

Material-transfer system 100 provides numerous advantages. Press tool 105 provides an automated, repetitive, and efficient manner to transfer material from container 106 to cartridge 107. As a result of this automated, repetitive, and efficient tool, workplace efficiency is increased as users no longer have to scoop material from a container to a cartridge. Moreover, flange 250 increases material utilization by ensuring that all material is used and preventing material from escaping container 106. Because of increased material utilization, significant costs are saved, particularly in situations involving high material costs. Additionally, flange 250 prevents workplace messes thereby increasing workplace efficiency and providing a safer working environment.

Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims. For example, a mechanical apparatus may apply a force to lever 150 rather than a user. As another example, a force may be applied to piston 108 using a tool other than press tool 105.

What is claimed is:

1. A system, comprising:

a press tool comprising:

a press base;

a guide rail attached to the press base and protruding upward from the press base;

a press slidably attached to the guide rail; and a lever coupled to the press, the lever configured to slide the press along the guide rail in response to a force applied to the lever;

a container configured to be positioned on the press base of the press tool, the container comprising an inner container wall and an outer container wall, the container configured to hold a material; and a piston configured to be positioned within the container, the piston comprising:

a body comprising an inner body wall and an outer body wall centered about a longitudinal axis, the inner body wall and the outer body wall forming a ridge at a first end of the body, the ridge configured to receive a force from the press;

a piston base at a second end of the body, the piston base comprising a flange configured to form a seal against the inner container wall, the piston base having an aperture centered about the longitudinal axis, the base centered about the longitudinal axis; and an inlet protruding from the piston base in a direction towards the first end of the body, the inlet configured to secure the piston to a nozzle of a cartridge.

2. The system of claim 1, wherein the press has a diameter that is greater than a second diameter of the cartridge such that the press is configured to apply a force to the ridge of the piston without applying the force to the cartridge.

3. The system of claim 1, wherein the flange is configured to form the seal against the inner container wall by having a shape matching at least a portion of a second shape of the inner container wall.

4. The system of claim 1, wherein the flange is configured to form the seal against the container wall by having a radius greater than or equal to a second radius of the inner container wall.

5. The system of claim 1, wherein the inlet comprises an inner inlet wall proximate to the longitudinal axis and an outer inlet wall distal to the longitudinal axis, at least a portion of the outer inlet wall comprising a plurality of threads.

6. The system of claim 1, wherein the piston base has a diameter greater than a second diameter of the body.

7. The system of claim 1, wherein the piston is made of a plastic.

* * * * *